US009704635B2

(12) United States Patent
Comtois et al.

(10) Patent No.: US 9,704,635 B2
(45) Date of Patent: Jul. 11, 2017

(54) ELECTROMAGNETIC ACTUATOR AND METHOD FOR PRODUCING SUCH AN ACTUATOR

(71) Applicant: SCHNEIDER ELECTRIC INDUSTRIES SAS, Rueil-Malmaison (FR)

(72) Inventors: Patrick Comtois, Saint Ismier (FR); Patrick Larcher, Echirolles (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 14/917,163

(22) PCT Filed: Oct. 20, 2014

(86) PCT No.: PCT/EP2014/072429
§ 371 (c)(1),
(2) Date: Mar. 7, 2016

(87) PCT Pub. No.: WO2015/059086
PCT Pub. Date: Apr. 30, 2015

(65) Prior Publication Data

US 2016/0196911 A1 Jul. 7, 2016

(30) Foreign Application Priority Data

Oct. 21, 2013 (FR) ..... 13 60246

(51) Int. Cl.
*H01F 7/127* (2006.01)
*H01F 7/08* (2006.01)
(Continued)

(52) U.S. Cl.
CPC ..... *H01F 7/127* (2013.01); *H01F 7/081* (2013.01); *H01F 7/121* (2013.01); *H01F 7/1607* (2013.01); *H01F 2007/1692* (2013.01)

(58) Field of Classification Search
CPC .. H01F 7/08; H01F 7/1607; H01F 2007/1692; H01F 7/081; H01F 7/121; H01F 7/127
See application file for complete search history.

(56) References Cited

U.S. PATENT DOCUMENTS 3,784,943 A 1/1974 Markowitz et al.
3,970,981 A * 7/1976 Coors ..... H01F 7/13 335/256

(Continued)

FOREIGN PATENT DOCUMENTS

DE 20 2007 008 281 U1 9/2007
EP 0 363 938 A1 4/1990
EP 2 250 651 11/2010

OTHER PUBLICATIONS

International Search Report Issued Jan. 23, 2015 in PCT/EP14/072429 filed Oct. 20, 2014.

*Primary Examiner* — Mohamad Musleh
(74) *Attorney, Agent, or Firm* — Oblon, McClelland, Maier & Neustadt, L.L.P.

(57) ABSTRACT

An electromagnetic actuator, including: a ferromagnetic housing extending in a longitudinal direction with a height in a vertical direction perpendicular to the longitudinal direction; two coils arranged inside the housing, each including at least one winding around the longitudinal direction; a ferromagnetic member arranged between the coils; and a ferromagnetic plunger subjected to a magnetic field generated by the coils, the plunger movable in the longitudinal direction and to be immobilized in three different longitudinal positions depending on the field generated by the coils. The ferromagnetic member is rigidly (Continued)

Figure 1:
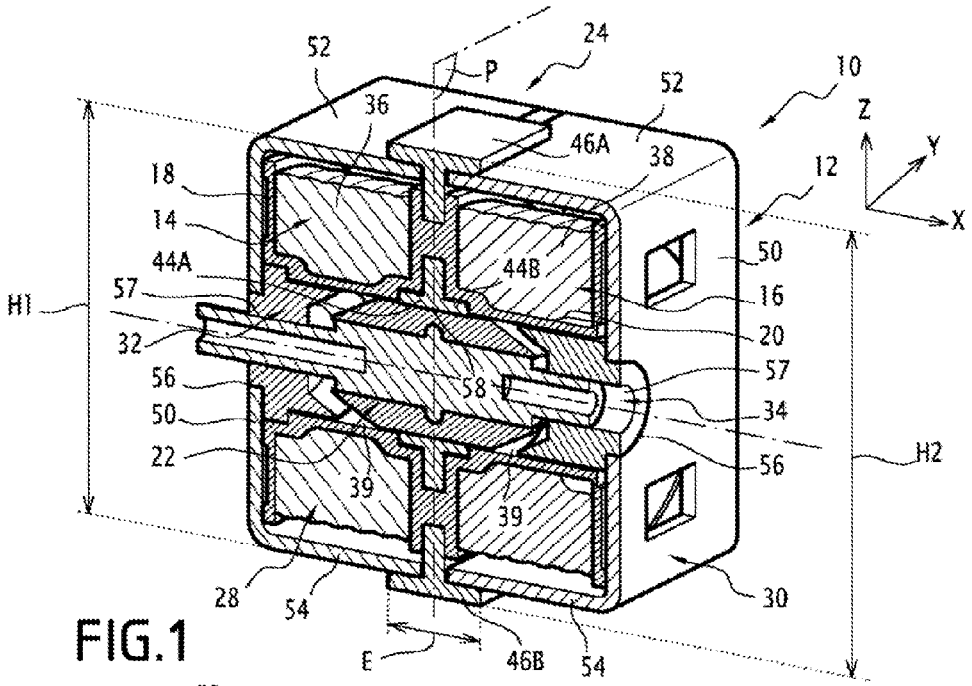

connected to the housing and has, in the vertical direction, a size greater than one sixth of the height of the housing, and located at a distance smaller than one fourth of a gap in the longitudinal direction between the two coils, relative to a median plane perpendicular to the longitudinal direction and located at the midpoint between the two coils.

11 Claims, 2 Drawing Sheets

(51) Int. Cl.
*H01F 7/121* (2006.01)
*H01F 7/16* (2006.01)

(56) References Cited

U.S. PATENT DOCUMENTS

| | | | |
|---|---|---|---|
| 5,016,681 | A | 5/1991 | Ghiardo |
| 2011/0001591 | A1 | 1/2011 | Puth et al. |

* cited by examiner

ELECTROMAGNETIC ACTUATOR AND METHOD FOR PRODUCING SUCH AN ACTUATOR

The present invention relates to an electromagnetic actuator. The actuator comprises a ferromagnetic housing, extending in a longitudinal direction and having a height in a vertical direction that is perpendicular to the longitudinal direction. The actuator comprises two electromagnetic coils positioned inside the housing, each comprising at least one winding around the longitudinal direction.

The actuator also comprises a ferromagnetic unit positioned between the coils and a ferromagnetic plunger subjected to a magnetic field generated by the coils, the ferromagnetic plunger being movable in the longitudinal direction and capable of being immobilized in three different longitudinal positions depending on the field generated by the coils.

The invention also relates to a method for producing such an electromagnetic actuator.

From the document EP 2 250 651, an electromagnetic actuator is known comprising two coils, a plunger capable of being immobilized in three positions, namely two end positions in respect of the coils and an intermediate position between the coils.

The plunger comprises a magnet and two units for guiding the flux from the magnet as far as the housing, in order to stabilize the plunger in its intermediate position. The actuator comprises an additional coil making it possible to offset the field of the magnet when the plunger is in a position other than its intermediate position.

However, such an actuator is relatively complex as it involves the presence of a magnet and an additional coil in order to allow better stability in the intermediate position.

The aim of the invention is therefore to propose an actuator with three positions having reduced cost and volume.

To this end, a subject of the invention is an electromagnetic actuator, in which the ferromagnetic unit is rigidly connected to the housing and has, in the vertical direction, a dimension that is greater than one sixth of the height of the housing, preferably greater than one quarter of said height, even more preferably greater than one third of said height, the ferromagnetic unit furthermore being located at a distance that is less than one quarter of a gap in the longitudinal direction between the two coils, relative to a midplane that is perpendicular to the longitudinal direction and located midway between the two coils, so as to guide the magnetic flux produced by the coils to the housing.

According to other advantageous aspects, the electromagnetic actuator comprises one or more of the following features, taken in isolation or according to any of the technically possible combinations:

- each electromagnetic coil comprises a coil former, the or each winding being fixed to the corresponding coil former, and the ferromagnetic unit is fixed to the two coil formers;
- the ferromagnetic unit comprises, in the longitudinal direction, a cutout through which the plunger can pass;
- the ferromagnetic unit extends from the cutout as far as the housing;
- the cutout has a peripheral edge, and the ferromagnetic unit comprises at least one flange extending from said peripheral edge;
- the flange extends in the longitudinal direction;

- the ferromagnetic unit comprises at least one outer protrusion, the or each outer protrusion being positioned outside the housing and at least partially in contact with the housing;
- the ferromagnetic unit comprises at least one inner protrusion, the or each inner protrusion being positioned inside the housing and at least partially in contact with the housing; and
- the protrusions are oriented in the longitudinal direction.

Another subject of the invention is a method for producing an electromagnetic actuator, the method comprising the steps consisting of:

a) producing a ferromagnetic housing extending in a longitudinal direction and having a height in a vertical direction that is perpendicular to the longitudinal direction, b) positioning two electromagnetic coils inside the housing, each coil comprising at least one winding around the longitudinal direction, c) positioning a ferromagnetic unit between the coils, d) placing a ferromagnetic plunger in a magnetic field generated by the coils, the plunger being movable in the longitudinal direction and capable of being immobilized in three different longitudinal positions depending on the field generated by the coils, in which, during step c), the ferromagnetic unit is rigidly connected to the housing and has, in the vertical direction, a dimension that is greater than one sixth of the height of the housing, preferably greater than one quarter of said height, even more preferably greater than one third of said height, the ferromagnetic unit furthermore being located at a distance that is less than one quarter of a gap in the longitudinal direction between the two coils, relative to a midplane that is perpendicular to the longitudinal direction and located midway between the two coils, so as to guide the magnetic flux produced by the coils to the housing.

According to another advantageous aspect, the production method comprises the following feature: during step c), the ferromagnetic unit is fixed to the housing by laser welding.

Figure 2:
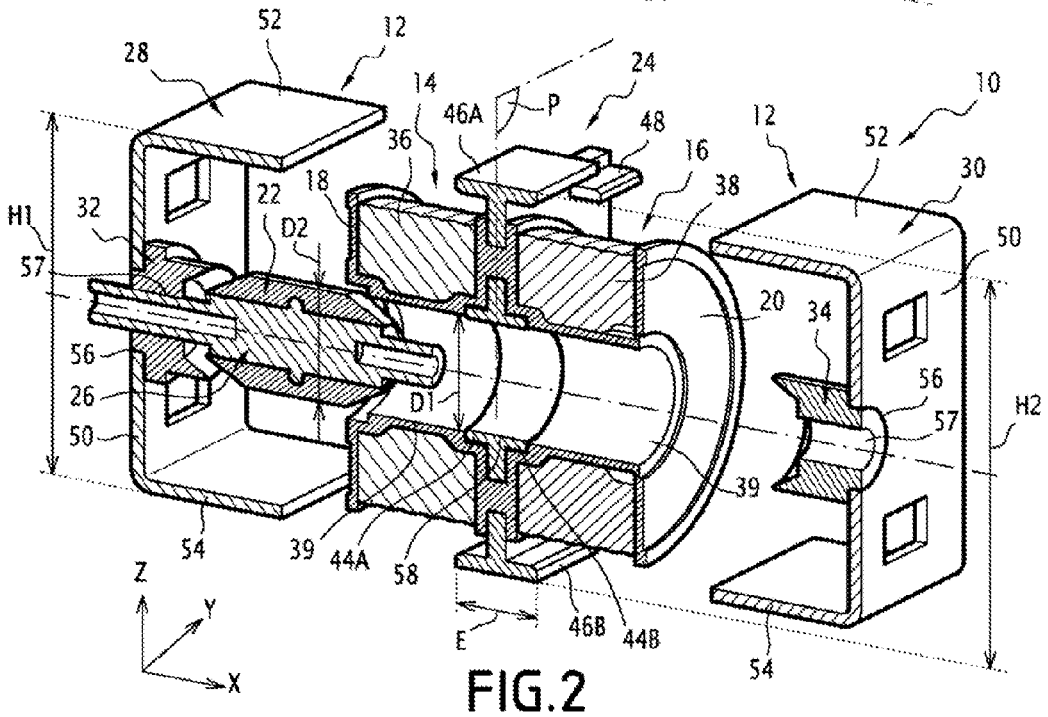
Figure 3:
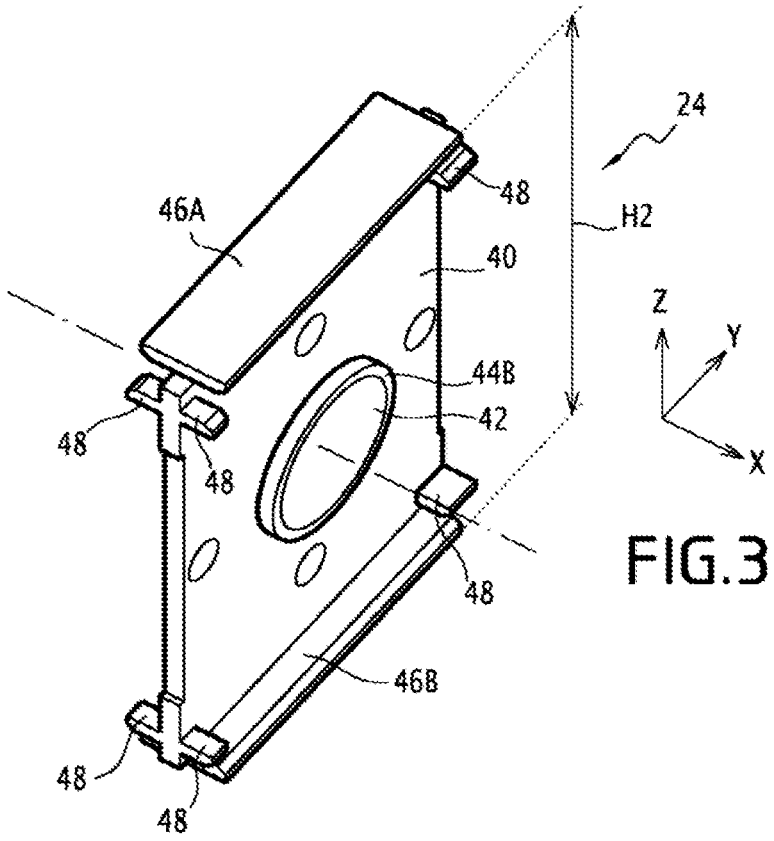
Figure 4:
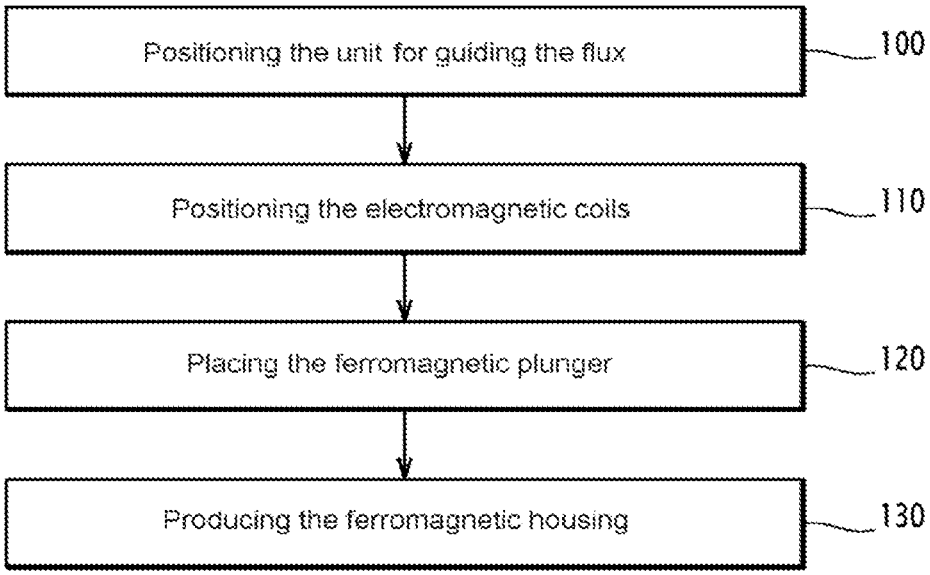

These features and advantages of the invention will become apparent upon reading the following description, given solely by way of non-limiting example and written with reference to the appended drawings, in which:

FIG. 1 is a perspective view of an actuator according to the invention, comprising a ferromagnetic housing, two electromagnetic coils, a translationally movable ferromagnetic plunger and a unit for guiding a magnetic flux generated by the coils, FIG. 2 is an exploded perspective view of the actuator of FIG. 1, FIG. 3 is a perspective view of the unit for guiding the flux of FIG. 1, and FIG. 4 is a flowchart for a production method according to the invention.

In FIGS. 1 and 2, an electromagnetic actuator 10 comprises a housing 12, two electromagnetic coils 14, 16, two coil formers 18, 20, a plunger 22, a unit for guiding a magnetic field generated by the coils 14, 16.

In addition, the electromagnetic actuator 10 comprises a rod 26 for guiding the plunger.

The electromagnetic actuator 10 is, for example, used for applying or disconnecting a current. It is particularly used for controlling the direction of rotation of an electric motor.

The housing 12 extends in a longitudinal direction X and has a generally cubic form with rounded edges. This housing 12 is preferably composed of a ferromagnetic material. The housing 12 comprises two U-shaped parts 28, 30 and two magnetic connecting pieces 32, 34.

The housing 12 has a first height H1 in a vertical direction Z that is perpendicular to the longitudinal direction X.

The two electromagnetic coils 14, 16 are positioned inside the housing 12. The two coils 14, 16 are, for example, coaxial relative to an axis in the longitudinal direction X. Each electromagnetic coil 14, 16 comprises a respective winding 36, 38.

The two coils 14, 16 are spaced apart by a gap E in the longitudinal direction X, as shown in FIGS. 1 and 2.

The two coil formers 18, 20 each hold a respective winding 36, 38 and fix the coils 14, 16 to the housing 12. The coil formers 18, 20 are preferably made of plastic. In the example of FIGS. 1 and 2, the coil formers 18, 20 preferably form a single plastic piece around which two copper wires are wound so as to form the respective windings 36, 38.

Each coil former 18, 20 revolves around the axis of the coils 14, 16 and has a U-shaped cross section open to the outside in a vertical plane containing the axis of the coils, as can be seen in FIGS. 1 and 2. The coil formers 18, 20 are then able to accommodate the windings 36, 38. The coil formers 18, 20 are fixed relative to the housing 12.

Each coil former 18, 20 forms, in its center, a substantially cylindrical tube 39 extending in the longitudinal direction X, and inside which the plunger 22 is able to slide, as shown in FIGS. 1 and 2.

The plunger 22 is subjected to a magnetic field generated by the coils 14, 16. This plunger 22 is translationally movable along the axis of the coils 14, 16. The plunger 22 comprises a ferromagnetic material, and is preferably composed of said ferromagnetic material.

The plunger 22 revolves around the longitudinal direction X, and is positioned around the guide rod 26.

The midpart of the plunger 22 has a cylindrical form in the longitudinal direction X and two convex conical forms at each of its ends in the longitudinal direction X, as shown in FIGS. 1 and 2.

The plunger 22 is capable of being immobilized in three different longitudinal positions, namely two end positions in respect of the coils 14, 16 and an intermediate position between the coils 14, 16. The intermediate position of the plunger 22 belongs, for example, to a midplane that is perpendicular to the longitudinal direction X and located midway between the two coils 14, 16.

The guide unit 24 is positioned between the coils 14, 16 and is fixed relative to the housing 12. The guide unit 24 preferably passes through the housing 12 so as to be fixed thereto.

The guide unit 24 has, in the vertical direction Z, a second height H2 that is greater than one sixth of the first height H1 of the housing 12, preferably greater than one quarter of said first height H1, even more preferably greater than one third of said first height H1.

In the exemplary embodiment described, the second height H2 of the guide unit 24 is greater than the first height H1 of the housing 12, as shown in FIGS. 1 and 2.

The guide unit 24, as can be seen in FIG. 3, comprises a main part 40, a cutout 42, first 44A and second 44B flanges. The guide unit 24 comprises upper 46A and lower 46B outer protrusions, and inner protrusions 48. The upper outer protrusion 46A is intended to be positioned outside and above the housing 12 in a vertical direction Z that is perpendicular to the longitudinal direction X, and the lower outer protrusion 46B is intended to be positioned outside and below the housing 12. The inner protrusions 48 are intended to be positioned inside the housing 12.

The guide unit 24 is composed of a ferromagnetic material, and is able to guide the magnetic flux generated by the coils 14, 16.

The guide unit 24 is, for example, in the form of a ferromagnetic plate positioned in a plane substantially perpendicular to the longitudinal direction X. The plane of the guide unit 24 is located, in the longitudinal direction X, at a distance that is less than one quarter of the gap E relative to a midplane P that is perpendicular to the longitudinal direction and located midway between the two coils 14, 16.

In the exemplary embodiment described, the plane of the guide unit 24 merges with the midplane P. In other words, the guide unit 24 is positioned in the intermediate position of the plunger 22 in the longitudinal direction X.

The guide rod 26, which can be seen in FIG. 2, is, for example, made of plastic. It passes all the way through the plunger 22 in the longitudinal direction X. The guide rod 26 is, for example, rigidly fixed to the plunger 22. The guide rod 26 has a largely cylindrical form.

The guide rod 26 is able to guide the plunger 22, in such a way that the latter moves only axially in the longitudinal direction X. In addition, the guide rod 26 guides the plunger 22 in such a way that it does not touch the inner wall of the tube 39 formed by the coil formers 18, 20, in order to reduce friction.

Each U-shaped part 28, 30 comprises three walls, namely a first transverse wall 50 that is perpendicular to the longitudinal direction X, an upper longitudinal wall 52 and a lower longitudinal wall 54. Each transverse wall 50 comprises an opening 56 through which a corresponding connecting piece 32, 34 can pass.

The two U-shaped parts 28, 30, once assembled, together form a fixed framework. This framework forms a support for fixing the other elements of the electromagnetic actuator 10.

The connecting pieces 32, 34 of the housing 12 are positioned at the longitudinal ends of the tube 39 formed by the coil formers 18, 20. These connecting pieces 32, 34 make it possible to limit the movement of the plunger 22 when it is in one of its end positions in respect of the coils 14, 16. These connecting pieces 32, 34 thus form stops. These connecting pieces 32, 34 are coaxial with the axis of the coils 14, 16, which is also the translational axis of the plunger 22.

Each connecting piece 32, 34 has a concave conical form that is oriented toward the inside of the actuator 10 in the longitudinal direction X. Alternatively, the concave form of the connecting pieces 32, 34 is oriented toward the plunger 22. These conical forms are complementary to the convex conical surfaces of the plunger 22, as shown in FIGS. 1 and 2.

The connecting pieces 32, 34 preferably comprise at least one ferromagnetic part, in order to provide improved guidance for a magnetic flux produced by the coils 14, 16.

Each connecting piece 32, 34 comprises a longitudinal through-hole 57 to allow the guide rod 26 to slide, and to limit the substantially radial movements of the guide rod 26, as shown in FIG. 2.

The main part 40 forms the central part of the unit 24. It is preferably flat and in the longitudinal direction X. It extends from the cutout 42, between the two coil formers 18, 20, as far as the ends of the housing 12.

The cutout 42 has a peripheral edge 58 in the plane of the guide unit 24 that is perpendicular to the longitudinal direction X.

The cutout 42 is formed in the main part 40. It is sufficiently wide in a radial direction that is perpendicular to a longitudinal direction X to allow the plunger 22 to pass through. This cutout 42 is oriented in the longitudinal direction X.

The cutout 42 has, in the radial direction, an internal diameter D1 matched to the external diameter D2 of the plunger 22 in this radial direction and to within a mechanical tolerance so as to allow the plunger 22 to slide, as shown in FIG. 2.

Each flange 44A, 44B extends from the peripheral edge 58 of the cutout, the first flange 44A in one direction and the second flange 44B in the other direction, in the longitudinal direction X, as can be seen in FIG. 3.

In the example of FIGS. 1 and 2, the flanges 44A, 44B fit into the two coil formers 18, 20 in the longitudinal extension of the tube 39, in such a way that the plunger 22 slides easily inside the tube 39, the cutout 42 and the flanges 44A, 44B.

The outer protrusions 46A, 46B are positioned outside the housing 12 and at least partially in contact with the housing 12. The guide unit 22 preferably comprises two outer protrusions 46A, 46B, namely the upper outer protrusion 46A and the lower outer protrusion 46B.

The outer protrusions 46A, 46B are oriented in the longitudinal direction X in both directions, as can be seen in FIG. 3. In other words, each outer protrusion 46A, 46B is adapted to be in contact with each of the two parts 28, 30 forming the housing 12.

Each outer protrusion 46A, 46B is, for example, in the form of a flat strip fixed so as to be perpendicular to the longitudinal direction, placed flat against the outer surface of the housing 12, as shown in FIG. 1.

The inner protrusions 48 are positioned inside the housing 12 and at least partially in contact with the housing 12. There are preferably two inner protrusions 48, one upper and one lower. These protrusions are oriented in the longitudinal direction X, as can be seen in FIG. 3.

Each inner protrusion 48 is, for example, in the form of a spur intended to be in contact with the inner surface of the housing 12.

The outer protrusions 46A, 46B and the inner protrusions 48 are, for example, positioned so as to sandwich the housing 12 between them. The unit 24 is then in contact both with the inner face and the outer face of the housing 12.

The method for producing the electromagnetic actuator 10 will now be described with the aid of the flowchart of FIG. 4.

The first step 100 consists of positioning the guide unit 24, equipped with its flanges 44A, 44B, its outer protrusions 46A, 46B and its inner protrusions 48. The unit 24 is positioned in the midplane that is perpendicular to the axis of the coils 14, 16. The guide unit 24 is preferably a ferromagnetic plate that is positioned so as to be perpendicular to the longitudinal direction X.

The unit for guiding flux 24 is formed, for example, by sintering two pieces, each being U-shaped in the longitudinal direction X, and the U-shaped pieces being oriented in opposite directions so as to form a general H shape extending in the longitudinal direction X.

The next step 110 consists of positioning the electromagnetic coils 14, 16 by fixing them to the unit 24.

The coil formers 18, 20 of the electromagnetic coils are then preferably overmolded around the unit for guiding flux 24. The coil formers 18, 20 preferably form a single plastic piece overmolded around the guide unit 24. In this case, during the first step 100, the guide unit 24 is positioned in a central position in a mold that is subsequently used for overmolding the coil formers 18, 20.

The windings 36, 38 are next produced by winding copper wire around the coil formers 18, 20, the latter having previously been fixed to the guide unit 24.

Next, during step 120, the guide rod 26 is placed into the ferromagnetic plunger 22, then the guide rod 26-plunger 22 assembly is placed into the tube 39 formed by the coil formers 18, 20.

Lastly, in step 130, the housing 12 is produced by placing the magnetic connecting pieces 32, 34, which allow the guide rod 26 to slide, into the U-shaped parts 28, 30, which fit together to form the housing 12.

The parts 28, 30, when being assembled, are sandwiched by the guide component 24 by means of the outer 46A, 46B and inner 48 protrusions.

The guide component 24 is then fixed to the body 12 by laser welding. The magnetic connecting pieces 32, 34 are fixed to the U-shaped parts 28, 30, also by laser welding.

The operation of the electromagnetic actuator 10 will now be described.

In order to move the plunger 22 to one of its end positions, one of the electromagnetic coils 14, 16 is supplied with electric power so as to generate a magnetic field that attracts the plunger 22. The other electromagnetic coil 14, 16 is not supplied with electric power, or else is supplied with electric power so as to generate a magnetic field that repels the plunger 22.

The magnetic field or fields generated produce a magnetic flux that is guided by the ferromagnetic parts of the electromagnetic actuator 10, i.e. by the housing 12, the plunger 22 and the guide unit 24. This arrangement minimizes the leakage flux and makes it possible to improve the efficiency of the electromagnetic actuator 10.

The movement of the plunger 22 to its intermediate position is, for example, ensured by a return spring, not shown. The use of a return spring makes it possible to avoid supplying power to the electromagnetic coils 14, 16 in order to move the plunger 22 to its intermediate position.

In a variant, the movement of the plunger 22 to its intermediate position is obtained by the generation of magnetic fields that repel, or else of fields that attract, the plunger 22, these repelling or attracting fields being generated by the two electromagnetic coils 14, 16 which are then supplied with electric power.

The plunger 22 then moves inside the tube 39, the cutout 42 and the flanges 44A, 44B, while being guided by the sliding of the guide rod 26 inside the connecting pieces 32, 34.

The guide unit 24 according to the invention then makes it possible to ensure improved mechanical stability for the plunger 22 in its intermediate position, the guide unit 24 improving the guidance of the magnetic fluxes to the housing 12 from the coils 14, 16.

The flanges 44A, 44B advantageously make it possible to improve the stability of the plunger 22 in its intermediate position by guiding the fluxes from the coils 14, 16 to the housing 12 to a greater extent. The orientation of the flanges 44A, 44B parallel to the translational axis of the plunger 22, i.e. in the longitudinal direction X, makes it possible to improve further this guidance of the fluxes by minimizing the reluctance between the plunger 22 and the main part 40 of the guide unit.

The outer protrusions 46A, 46B make it possible to improve further the stability of the plunger 22 in its intermediate position by improving the guidance of the fluxes. The positioning of the outer protrusions 46A, 46B in the longitudinal direction X parallel to the longitudinal walls of the housing 12 makes it possible to improve further this guidance of the fluxes by minimizing the reluctance between the housing 12 and the main part 40 of the guide unit.

Thus, the ferromagnetic unit 24 allows, through its considerable radial dimensions and through its positioning between the electromagnetic coils 14, 16, optimal guidance of the magnetic flux produced by the coils 14, 16, the plunger 22 is drawn toward its intermediate position. This thus improves the stability of the intermediate position of the plunger 22 without recourse to other devices, such as the magnet and the additional coil of the actuator of the prior art.

The ferromagnetic coil formers 18, 20 make it possible to fix the coils 14, 16 so that they each exert a magnetic field for controlling the position of the plunger 22.

The overmolding of the coil formers 18, 20 allows improved coaxial positioning of the coils 14, 16 relative to the translational axis of the plunger 22 in the longitudinal direction X.

The shape of the plunger 22, with its two convex conical forms at each of its ends in the longitudinal direction X, makes it possible to reduce the ferromagnetic mass aboard the actuator 10, and also to scale down a resistive force chart.

The complementarity of the conical forms of the plunger 22 with the respective conical forms of the magnetic connecting pieces 32, 34 allows geometrically coaxial repositioning, while preventing, via the guide rod 26, said conical forms from sticking together.

In addition, the fact that the ferromagnetic unit 24 extends from the cutout 42 up to the housing 12 allows optimal guidance of the magnetic flux up to the housing, and decreases the magnetic reluctance of the overall electromagnetic actuator 10.

It will thus be understood that the electromagnetic actuator 10 according to the invention makes it possible to improve the stability of the intermediate position of the plunger 22, while having reduced cost and volume compared to the electromagnetic actuator of the prior art.

The invention claimed is:

1. An electromagnetic actuator comprising:

a ferromagnetic housing extending in a longitudinal direction and having a height in a vertical direction that is perpendicular to the longitudinal direction;

two electromagnetic coils positioned inside the housing and each comprising at least one winding around the longitudinal direction;

a ferromagnetic unit arranged between the coils;

a ferromagnetic plunger subjected to a magnetic field generated by the coils, the plunger being movable in the longitudinal direction and configured to be immobilized in three different longitudinal positions depending on the field generated by the coils;

wherein the ferromagnetic unit is rigidly connected to the housing and has, in the vertical direction, a dimension that is greater than one sixth of the height of the housing, the ferromagnetic unit further being located at a distance that is less than one quarter of a gap in the longitudinal direction between the two coils, relative to a midplane that is perpendicular to the longitudinal direction and located midway between the two coils, to guide the magnetic flux produced by the coils to the housing, and wherein the ferromagnetic unit comprises at least one protrusion, each protrusion being at least partially in contact with the housing.

2. The actuator as claimed in claim 1, wherein each electromagnetic coil comprises a coil former, each winding being fixed to the corresponding coil former, and the ferromagnetic unit is fixed to the coil formers.

3. The actuator as claimed in claim 1, wherein the ferromagnetic unit comprises, in the longitudinal direction, a cutout through which the plunger can pass.

4. The actuator as claimed in claim 3, wherein the ferromagnetic unit extends from the cutout as far as the housing.

5. The actuator as claimed in claim 3, wherein the cutout has a peripheral edge, and the ferromagnetic unit comprises at least one flange extending from the peripheral edge.

6. The actuator as claimed in claim 5, wherein the flange extends in the longitudinal direction.

7. The actuator as claimed in claim 1, wherein at least one protrusion is an outer protrusion, each outer protrusion being positioned outside the housing.

8. The actuator as claimed in claim 1, wherein at least one protrusion is an inner protrusion, each inner protrusion being positioned inside the housing.

9. The actuator as claimed in claim 1, wherein the protrusions are oriented in the longitudinal direction.

10. A method for producing an electromagnetic actuator, the method comprising:

a) producing a ferromagnetic housing extending in a longitudinal direction and having a height in a vertical direction perpendicular to the longitudinal direction;

b) positioning two electromagnetic coils inside the housing, each coil comprising at least one winding around the longitudinal direction;

c) positioning a ferromagnetic unit between the coils;

d) placing a ferromagnetic plunger in a magnetic field generated by the coils, the plunger being movable in the longitudinal direction and configured to be immobilized in three different longitudinal positions depending on the field generated by the coils;

wherein, during c), the ferromagnetic unit is rigidly connected to the housing and has, in the vertical direction, a dimension that is greater than one sixth of the height of the housing, the ferromagnetic unit further being located at a distance that is less than one quarter of a gap in the longitudinal direction between the two coils, relative to a midplane that is perpendicular to the longitudinal direction and located midway between the two coils, to guide the magnetic flux produced by the coils to the housing, and wherein, during c), the ferromagnetic unit comprises at least one protrusion, each protrusion being at least partially in contact with the housing.

11. The method as claimed in claim 10, wherein, during c), the ferromagnetic unit is fixed to the housing by laser welding.

* * * * *